US011826871B2

(12) United States Patent
Uozumi et al.

(10) Patent No.: US 11,826,871 B2
(45) Date of Patent: Nov. 28, 2023

(54) PAD-TEMPERATURE REGULATING APPARATUS, PAD-TEMPERATURE REGULATING METHOD, AND POLISHING APPARATUS

(71) Applicant: EBARA CORPORATION, Tokyo (JP)

(72) Inventors: Shuji Uozumi, Tokyo (JP); Toru Maruyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 198 days.

(21) Appl. No.: 17/242,886

(22) Filed: Apr. 28, 2021

(65) Prior Publication Data

US 2021/0347004 A1 Nov. 11, 2021

(30) Foreign Application Priority Data

May 8, 2020 (JP) ..... 2020-082423

(51) Int. Cl.
*B24B 37/015* (2012.01)

(52) U.S. Cl.
CPC ..... *B24B 37/015* (2013.01)

(58) Field of Classification Search
CPC ..... B24B 37/015; B24B 37/20; B24B 37/105; B24B 57/02
USPC ..... 451/7, 5, 41, 60, 287
See application file for complete search history.

(56) References Cited

U.S. PATENT DOCUMENTS

2008/0311823 A1* 12/2008 Aiyoshizawa ..... B24B 55/02 451/7
2015/0079881 A1* 3/2015 Maruyama ..... B24B 49/14 451/259
2019/0287826 A1* 9/2019 Takagi ..... B24B 37/015

FOREIGN PATENT DOCUMENTS

CN 207171777 * 4/2018 ..... B24B 37/00
JP 2001-062706 A 3/2001
JP 5390807 A 1/2014
JP 2017-148933 A 8/2017
JP 2018-027582 A 2/2018

* cited by examiner

*Primary Examiner* — Joel D Crandall
*Assistant Examiner* — Shantese L McDonald
(74) *Attorney, Agent, or Firm* — PEARNE & GORDON LLP

(57) ABSTRACT

A pad-temperature regulating device is disclosed, which can improve a responsiveness of a control for a surface temperature of a polishing pad and regulate the surface temperature of the polishing pad without causing defects, such as scratches, on the substrate. The pad-temperature regulating apparatus includes: a heat exchanger disposed above the polishing pad, whose temperature is maintained at a predetermined temperature; a pad-temperature measuring device configured to measure the surface temperature of the polishing pad; a distance sensor configured to measure a separation distance between the polishing pad and the heat exchanger; an elevating mechanism for moving the heat exchanger vertically with respect to the polishing pad; and a controller configured to control operation of the elevating mechanism based on measured values of the pad-temperature measuring device.

15 Claims, 10 Drawing Sheets

PAD-TEMPERATURE REGULATING APPARATUS, PAD-TEMPERATURE REGULATING METHOD, AND POLISHING APPARATUS

CROSS REFERENCE TO RELATED APPLICATION

This document claims priority to Japanese Patent Application No. 2020-082423 filed May 8, 2020, the entire contents of which are hereby incorporated by reference.

BACKGROUND

A polishing apparatus is known, which holds and rotates the substrate, such as a wafer, with a polishing head, and presses the wafer against a polishing pad on a rotating polishing table to polish the surface of the substrate. During polishing of the substrate, a polishing liquid (or slurry) is supplied onto the polishing pad, so that the surface of the substrate is planarized by the chemical action of the polishing liquid and the mechanical action of abrasive grains contained in the polishing liquid.

A polishing rate of the substrate depends not only on a polishing load on the substrate pressed against the polishing pad, but also on a surface temperature of the polishing pad. This is because the chemical action of the polishing liquid on the wafer depends on the temperature. Therefore, in a manufacturing of a semiconductor device, it is important to maintain an optimum surface temperature of the polishing pad during polishing of the wafer in order to increase the polishing rate of the wafer, and to keep the increased polishing rate constant.

From this viewpoint, a pad-temperature regulating apparatus is conventionally used to regulate a surface temperature of a polishing pad (see Japanese laid-open patent publication No. 2017-148933 and Japanese laid-open patent publication No. 2018-027582, for example). The pad-temperature regulating apparatus typically includes a heat exchanger capable of contacting a surface of the polishing pad, a liquid supply system for supplying a heating liquid having a regulated temperature and a cooling liquid having a regulated temperature into the heat exchanger, a pad-temperature measuring device for measuring the surface temperature of the polishing pad, and a controller for controlling the liquid supply system based on the surface temperature of the polishing pad measured by the pad-temperature measuring device. The controller controls flow rates of the heating liquid and the cooling liquid based on a pad surface temperature measured by the pad-temperature measuring device such that the surface temperature of the polishing pad reach a predetermined target temperature and is subsequently maintained at the target temperature.

However, the heat exchanger of the pad-temperature regulating apparatus is inevitably placed into contact with the polishing liquid during polishing of the substrate, resulting in attaching dirt, such as abrasive grains contained in the polishing liquid, and abrasion powder of the polishing pad to the heat exchanger. The dirt may fall off the heat exchanger during polishing of the substrate, resulting in causing occurrence of contamination of the substrate, and defects, such as scratches, on the substrate.

Further, in the conventional control method of the pad-temperature regulating apparatus, two conflicting parameters, i.e., the flow rate of the heating liquid and the flow rate of the cooling liquid, are simultaneously controlled, and thus the conventional control method is relatively complicated.

Therefore, there is a demand for a simpler control of the surface temperature of the polishing pad to improve the responsiveness of the control for the surface temperature of the polishing pad.

SUMMARY OF THE INVENTION

Therefore, there are provided a pad-temperature regulating apparatus and a pad-temperature regulating method capable of improving the responsiveness of the control for the surface temperature of the polishing pad and together regulating the surface temperature of the polishing pad without causing defects, such as scratches, on the substrate. Further, there is provided a polishing apparatus in which such pad-temperature regulating apparatus is incorporated.

Embodiments, which will be described below, relate to a pad-temperature regulating apparatus and a pad-temperature regulating method for regulating a surface temperature of a polishing pad used for polishing of a substrate, such as a wafer. Further, embodiments, which will be described below, also relate to a polishing apparatus in which the pad-temperature regulating apparatus is incorporated.

In an embodiment, there is provided a pad-temperature regulating apparatus for regulating a surface temperature of a polishing pad to a predetermined target temperature, comprising: a heat exchanger disposed above the polishing pad, whose temperature is maintained at a predetermined temperature; a pad-temperature measuring device configured to measure the surface temperature of the polishing pad; a distance sensor configured to measure a separation distance between the polishing pad and the heat exchanger; an elevating mechanism for moving the heat exchanger vertically with respect to the polishing pad; and a controller configured to control operation of the elevating mechanism based on measured values of the pad-temperature measuring device.

In an embodiment, the heat exchanger includes a heating flow passage formed therein, and the heating flow passage is supplied with a heating liquid, whose temperature is maintained at a predetermined temperature, at a predetermined flow rate.

In an embodiment, the pad-temperature regulating apparatus further comprises a cooling mechanism for cooling the surface of the polishing pad, wherein the controller operates the cooling mechanism when the target temperature is lower than the measured value of the pad-temperature measuring device after the elevating mechanism reaches an upper limit of movement of the heat exchanger.

In an embodiment, the cooling mechanism includes a cooling flow passage formed in the heat exchanger, into which a cooling liquid is supplied, and the controller controls a flow rate of the cooling liquid based on the measured values of the pad-temperature measuring device.

In an embodiment, the controller includes: a memory which stores a learned model constructed by machine learning using training data including at least a combination of the distance between the heat exchanger and the polishing pad, and the temperature of the surface of the polishing pad corresponding to the distance; and a processing device for operating to input temperature control parameters which include at least the target temperature and the measured value of the pad-temperature measuring device into the learned model, and to output an amount of operation of the elevating mechanism.

In an embodiment, there is provided a pad-temperature regulating method for regulating a surface temperature of a polishing pad to a predetermined target temperature, comprising: measuring the surface temperature of the polishing pad; and moving a heat exchanger, which is disposed above the polishing pad, and whose temperature is maintained at a predetermined temperature, vertically with respect to the polishing pad to thereby regulating the surface temperature of the polishing pad to the target temperature.

In an embodiment, in order to maintain the heat exchanger at the predetermined temperature, a heating liquid, whose temperature is maintained at a predetermined temperature, is supplied at a predetermined flow rate to the heating flow passage formed in the heat exchanger.

In an embodiment, a cooling mechanism is used to cool the surface of the polishing pad when, after the heat exchanger reaches an upper limit of movement, the target temperature is lower than the measured value of the pad-temperature measuring device.

In an embodiment, cooling of the surface of the polishing pad is controlling of a flow rate of cooling liquid flowing through a cooling flow passage formed in the heat exchanger based on measured values of the pad-temperature measuring device.

In an embodiment, a learned model is constructed by machine learning using training data including at least a combination of a distance between the heat exchanger and the polishing pad, and a temperature of the surface of the polishing pad corresponding to the distance, and temperature control parameters, which include at least the target temperature and the measured value of the pad-temperature measuring device, are input to the learned model to output an amount of operation of the elevating mechanism.

In an embodiment, there is provided a polishing apparatus, comprising: a polishing table supporting a polishing pad; a polishing head for pressing a substrate against the polishing pad; a pad-temperature measuring device for measuring a surface temperature of the polishing pad; and the above-mentioned pad-temperature regulating apparatus According to the above-described embodiments, the heat exchanger is disposed above the polishing pad, so that dirt, such as abrasive grains contained in the polishing liquid, and abrasion powder of the polishing pad, cannot adhere to the heat exchanger. As a result, defects, such as scratches, and contamination on the substrate are prevented. Further, the controller controls only the distance of the heat exchanger with respect to the polishing pad in order to match the surface temperature of the polishing pad to the target temperature. Therefore, it is possible to improve the responsiveness of the control for the surface temperature of the polishing pad with the simple control.

DESCRIPTION OF EMBODIMENTS

Embodiments will now be described with reference to the drawings.

Figure 1:
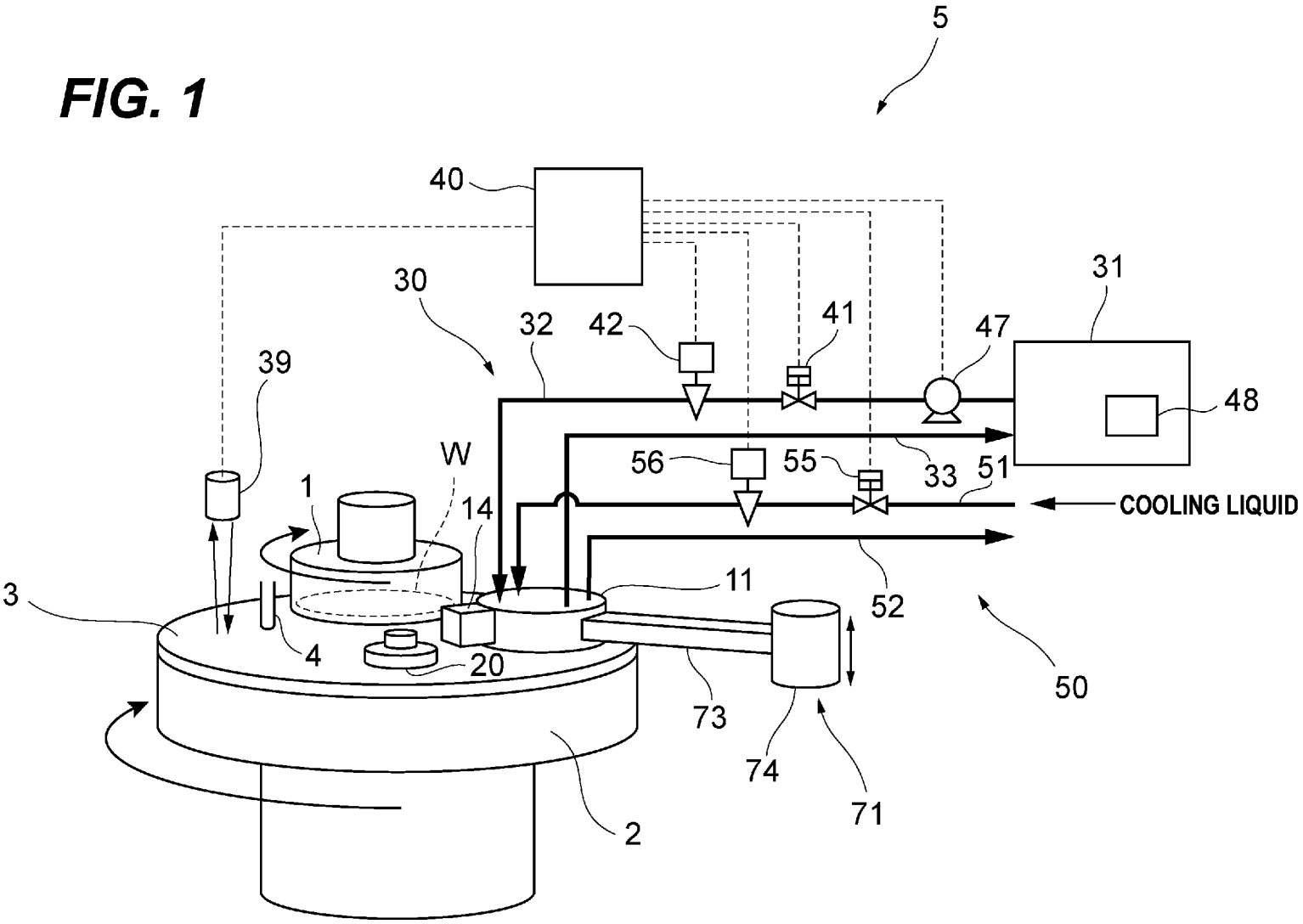
FIG. 1 is a schematic view showing a polishing apparatus according to an embodiment.

FIG. 1 is a schematic view showing a polishing apparatus according to an embodiment. As shown in FIG. 1, the polishing apparatus includes a polishing head 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3 and a pad-temperature regulating apparatus 5 for regulating a surface temperature of the polishing pad 3. The surface (upper surface) of the polishing pad 3 provides a polishing surface for polishing the wafer W.

The polishing head 1 is vertically movable, and is rotatable about its axis in a direction indicated by arrow. The wafer W is held on a lower surface of the polishing head 1 by, for example, vacuum suction. A motor (not shown) is coupled to the polishing table 2, so that the polishing table 2 can rotate in a direction indicated by arrow. As shown in FIG. 1, the polishing head 1 and the polishing table 2 rotate in the same direction. The polishing pad 3 is attached to an upper surface of the polishing table 2.

The polishing apparatus showing in FIG. 1 further includes a dresser 20 that dresses the polishing pad 3 on the polishing table 2. The dresser 20 is configured to oscillate on the surface of the polishing pad 3 in a radial direction of the polishing pad 3. The dresser 20 has a lower surface serving as a dressing surface constituted by a number of abrasive grains, such as diamond particles. The dresser 20 rotates, while oscillating on the polishing surface of the polishing pad 3, to scrape away the polishing pad 3 slightly, thereby dressing the surface of the polishing pad 3.

Polishing of the wafer W is performed in the following manner. The wafer W, to be polished, is held by the polishing head 1, and is then rotated by the polishing head 1. The polishing pad 3 is rotated together with the polishing table 2. In this state, the polishing liquid is supplied from the polishing-liquid supply nozzle 4 onto the surface of the polishing pad 3, and the surface of the wafer W is then pressed by the polishing head 1 against the surface (i.e. polishing surface) of the polishing pad 3. The surface of the wafer W is polished by the sliding contact with the polishing pad 3 in the presence of the polishing liquid. The surface of the wafer W is planarized by the chemical action of the polishing liquid and the mechanical action of abrasive grains contained in the polishing liquid.

The pad-temperature regulating apparatus 5 includes a heat exchanger 11 disposed above the polishing pad 3, a pad-temperature measuring device 39 for measuring the surface temperature of the polishing pad 3 (which may hereinafter be referred to as pad surface temperature), a heating-liquid supply system 30 for supplying the heating liquid, regulated to a predetermined temperature, into the heat exchanger 11 at a predetermined flow rate, an elevating mechanism 71 for moving the heat exchanger 11 vertically with respect to the polishing pad 3, and a controller 40 for controlling operation of the elevating mechanism 71 based on measured values of the pad-temperature measuring device 39. In this embodiment, the controller 40 is configured to control operations of the polishing apparatus as a whole, including the pad-temperature regulating apparatus 5.

The heating-liquid supply system 30 shown in FIG. 1 includes a heating-liquid supply tank 31 as a heating-liquid supply source for storing the heating liquid regulated to the predetermined temperature, and a heating-liquid supply pipe 32 and a heating-liquid return pipe 33, each coupling the heating-liquid supply tank 31 to the heat exchanger 11. One ends of the heating-liquid supply pipe 32 and the heating-liquid return pipe 33 are coupled to the heating-liquid supply tank 31, while the other ends are coupled to the heat exchanger 11.

The heating liquid having the regulated temperature is supplied from the heating-liquid supply tank 31 to the heat exchanger 11 through the heating-liquid supply pipe 32, flows in the heat exchanger 11, and is retuned from the heat exchanger 11 to the heating-liquid supply tank 31 through the heating-liquid return pipe 33. In this manner, the heating liquid circulates between the heating-liquid supply tank 31 and the heat exchanger 11. In this embodiment, the heating-liquid supply tank 31 has a heating source (i.e., heater) 48 disposed therein. This heating source 48 heats the heating liquid, stored in the heating-liquid supply tank 31, to the predetermined temperature (i.e., set temperature).

A first on-off valve (heating-liquid supply valve) 41 and a first flow control valve (heating-liquid flow control valve) 42 are attached to the heating-liquid supply pipe 32. The first flow control valve 42 is located between the heat exchanger 11 and the first on-off valve 41. The first on-off valve 41 is a valve not having a flow rate regulating function, whereas the first flow control valve 42 is a valve having a flow rate regulating function. The first flow control valve 42 is connected to the controller 40, and thus adjusts a flow rate of the heating liquid supplied to the heat exchanger 11 to a predetermined flow rate (i.e., set flow rate).

Hot water may be used as the heating liquid to be supplied to the heat exchanger 11. The hot water is heated to about 80° C., for example, by the heating source 48 in the heating-liquid supply tank 31. If the temperature of the heating liquid is to be set at a higher temperature, a silicone oil may be used as the heating liquid. In the case of using the silicone oil as the heating liquid, the silicone oil is heated by the heating source 48 of the liquid supply tank 31 to a set temperature of 100° C. or more (for example, about 120° C.).

In this manner, the heat exchanger 11 is supplied with heating liquid that is regulated to the predetermined temperature and flows at the predetermined flow rate, so that the temperature of the heat exchanger 11 is maintained at a constant temperature. The heat exchanger 11 is disposed above the polishing pad 3, and thus the surface of the polishing pad 3 is heated by radiant heat from the heat exchanger 11.

Although details will be described later, as shown in FIG. 1, the pad-temperature regulating apparatus 5 may include a cooling-liquid supply system 50 for supplying a cooling liquid into the heat exchanger 11. The cooling-liquid supply system 50 serves as a cooling mechanism for cooling the surface of the polishing pad 3. Although, in following description, embodiments of the pad-temperature regulating apparatus 5 including the cooling-liquid supply system 50 are described, the pad-temperature regulating apparatus 5 may omit the cooling-liquid supply system 50.

The cooling-liquid supply system 50 includes a cooling-liquid supply pipe 51 and a cooling-liquid discharge pipe 52, both coupled to the heat exchanger 11. The cooling-liquid supply pipe 51 is coupled to a cooling-liquid supply source (e.g. a cold-water supply source) provided in a factory in which the polishing apparatus is installed. The cooling liquid is supplied to the heat exchanger 11 through the cooling-liquid supply pipe 51, flows in the heat exchanger 11, and is drained from the heat exchanger 11 through the cooling-liquid discharge pipe 52. In one embodiment, the cooling liquid that has flowed through the heat exchanger 11 may be returned to the cooling-liquid supply source through the cooling-liquid discharge pipe 52.

A second on-off valve (cooling-liquid supply valve) 55 and a second flow control valve (cooling-liquid flow control valve) 56 are attached to the cooling-liquid supply pipe 51. The second flow control valve 56 is located between the heat exchanger 11 and the second on-off valve 55. The second on-off valve 55 is a valve not having a flow rate regulating function, whereas the second flow control valve 56 is a valve having a flow rate regulating function. The second flow control valve 56 is connected to the controller 40, and thus adjusts a flow rate of the cooling liquid supplied to the heat exchanger 11 to a predetermined flow rate (i.e., set flow rate).

Cold water or a silicone oil may be used as the cooling liquid to be supplied to the heat exchanger 11. In the case of using a silicone oil as the cooling liquid, the polishing pad 3 can be cooled quickly by coupling a chiller as a cooling-liquid supply source to the cooling-liquid supply pipe 51, and by cooling the silicone oil to a temperature of not more than 0° C. Pure water can be used as the cold water. In order to cool pure water to produce cold water, a chiller may be used as a cooling-liquid supply source. In this case, cold water that has flowed through the heat exchanger 11 may be returned to the chiller through the cooling-liquid discharge pipe 52.

The heating-liquid supply pipe 32 of the heating-liquid supply system 30 and the cooling-liquid supply pipe 51 of the cooling-liquid supply system 50 are completely independent pipes. Thus, the heating liquid and the cooling liquid can be simultaneously supplied to the heat exchanger 11 without mixing with each other. The heating-liquid return pipe 33 and the cooling-liquid discharge pipe 52 are also completely independent pipes. Thus, the heating liquid is returned to the heating-liquid supply tank 31 without mixing with the cooling liquid, while the cooling liquid is either drained or returned to the cooling-liquid supply source without mixing with the heating liquid.

Figure 2:
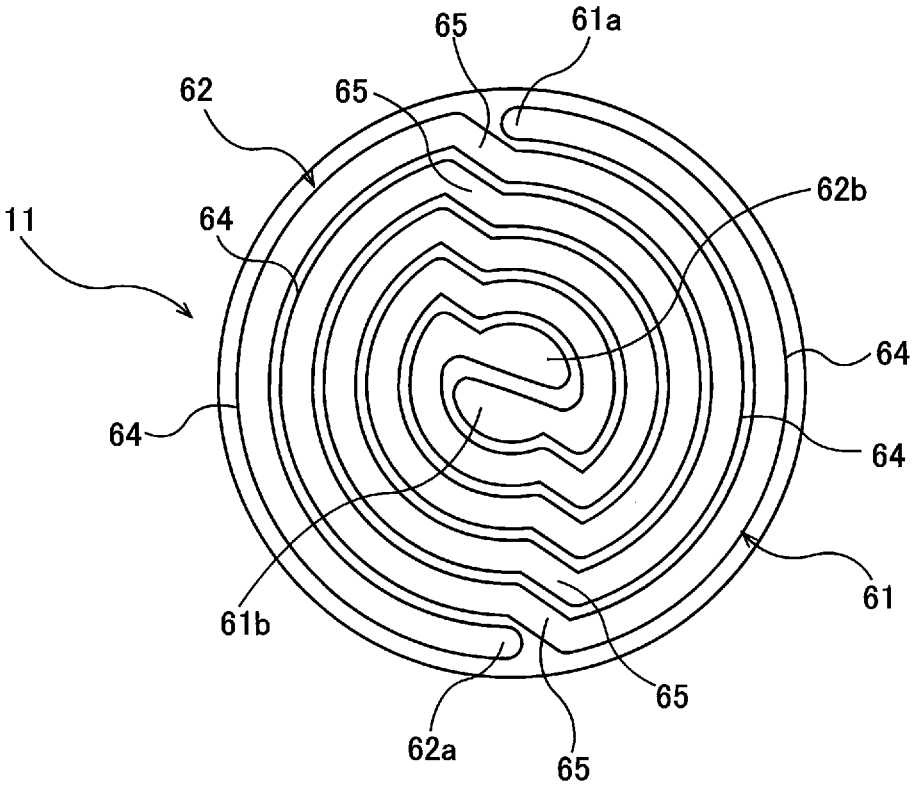
FIG. 2 is a horizontal cross-sectional view showing a heat exchanger according to an embodiment.

FIG. 2 is a horizontal cross-sectional view showing the heat exchanger 11 according to an embodiment. The heat exchanged 1 shown in FIG. 2 has a heating flow passage 61 and a cooling flow passage 62 formed therein. The heating flow passage 61 and the cooling flow passage 62 are arranged next to each other (or side by side), and extend in a spiral shape. Further, the heating flow passage 61 and the cooling flow passage 62 are completely separated, so that the heating liquid and the cooling liquid are not mixed in the heat exchanger 11.

The heating-liquid supply pipe 32 is coupled to an inlet 61*a* of the heating flow passage 61, and the heating-liquid return pipe 33 is coupled to an outlet 61*b* of the heating flow passage 61. The cooling-liquid supply pipe 51 is coupled to an inlet 62*a* of the cooling flow passage 62, and the cooling-liquid discharge pipe 52 is coupled to an outlet 62*b* of the cooling flow passage 62. Each of the heating flow passage 61 and the cooling flow passage 62 basically comprises a plurality of arc flow passages 64 having a constant curvature and a plurality of inclined flow passages 65 coupling the arc flow passages 64. Two adjacent arc flow passages 64 are coupled by each inclined flow passage 65. Such constructions make it possible to locate the outermost portions of the heating flow passage 61 and the cooling flow passage 62 at an outermost portion of the heat exchanger 11. Specifically, the entire bottom surface of the heat exchanger 11 lies under the heating flow passage 61 and the cooling flow passage 62. Therefore, the heating liquid and the cooling liquid can quickly heat and cool the polishing surface of the polishing pad 3.

Referring back to FIG. 1, the pad-temperature measuring device 39 is disposed above the surface of the polishing pad 3, and is configured to measure the surface temperature of the polishing pad 3 in a non-contact manner. The pad-temperature measuring device 39 is coupled to the controller 40 to send measured values to the controller 40.

The pad-temperature measuring device 39 may be an infrared radiation thermometer or thermocouple thermometer which measures the surface temperature of the polishing pad 3, or may be a temperature-distribution measuring device which acquires a temperature distribution (temperature profile) of the polishing pad 3 along the radial direction of the polishing pad 3. Examples of the temperature-distribution measuring device include a thermography, a thermopile, and an infrared camera. In the case in which the pad-temperature measuring device 39 is the temperature-distribution measuring device, the pad-temperature measuring device 39 is configured to measure a distribution of the surface temperature of the polishing pad 3 in an area including a center CL and a peripheral portion of the polishing pad 3 and extending in a radial direction of the polishing pad 3. In this specification, the temperature distribution (temperature profile) indicates a relationship between the pad surface temperature and the radial position on the wafer W.

The elevating mechanism 71 of the pad-temperature regulating apparatus 5 is a device for moving the heat exchanger 11 in the vertical direction with respect to the polishing pad 3 within a range where the heat exchanger 11 does not come into contact with the surface of the polishing pad 3. The elevating mechanism 71 includes at least an actuator 74 capable of moving the heat exchanger 11 in the vertical direction.

The elevating mechanism 71 shown in FIG. 1 has a support member 73 coupled to the heat exchanger 11, and the actuator 74 for moving the heat exchanger 11 vertically through the support member 73. Configuration of the actuator 74 is free-selected as long as the heat exchanger 11 can be moved in the vertical direction. For example, the actuator 74 may be a piston-cylinder device with a piston which moves the heat exchanger 11 up and down through the support member 73, or a motor (e.g., a servo motor or a stepping motor) which moves the heat exchanger 11 up and down through the support member 73. In one embodiment, the actuator 74 may be a piezoelectric actuator that uses the piezoelectric effect of a piezoelectric element to move the heat exchanger 11 up and down through the support member 73.

The elevating mechanism 71 is connected to the controller 40. The controller 40 controls operation of the elevating mechanism 71 (i.e., amounts of operation of the actuator 74) based on the measured values of the pad-temperature measuring device 39 to thereby adjust a position of the heat exchanger 11 with respect to the polishing pad 3 in the vertical direction. As described above, the heat exchanger 11 is heated to the predetermined temperature, and maintained to that predetermined temperature. Therefore, the heat exchanger 11 is moved closer to the polishing pad 3, enabling the pad surface temperature to be increased. When the heat exchanger 11 is moved away from the polishing pad 3, the pad surface temperature is decreased.

Figure 3:
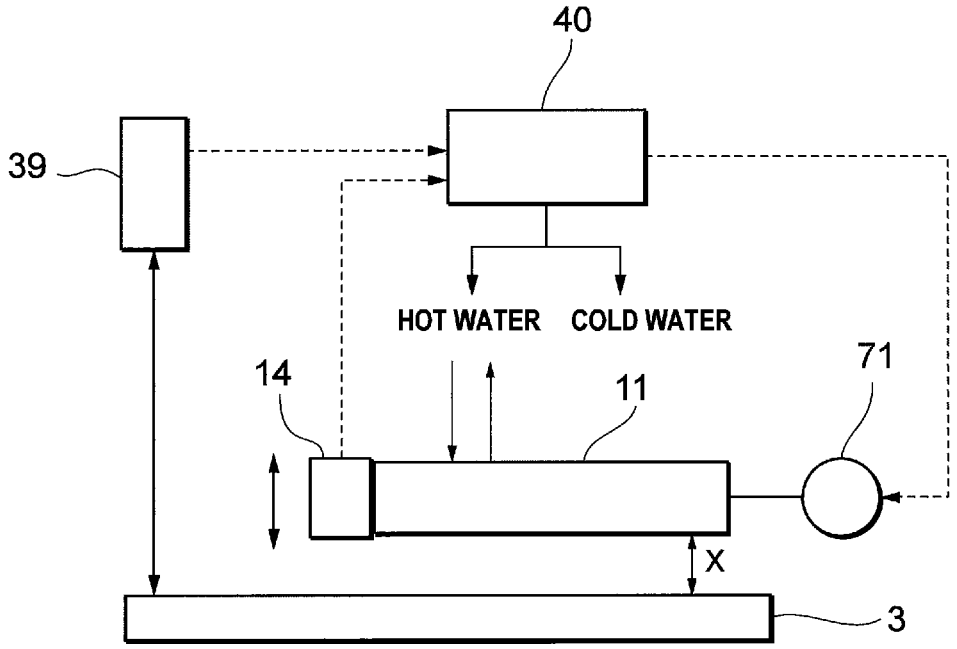
FIG. 3 is a schematic view showing a manner in which the heat exchanger regulates a pad surface temperature.
Figure 4:
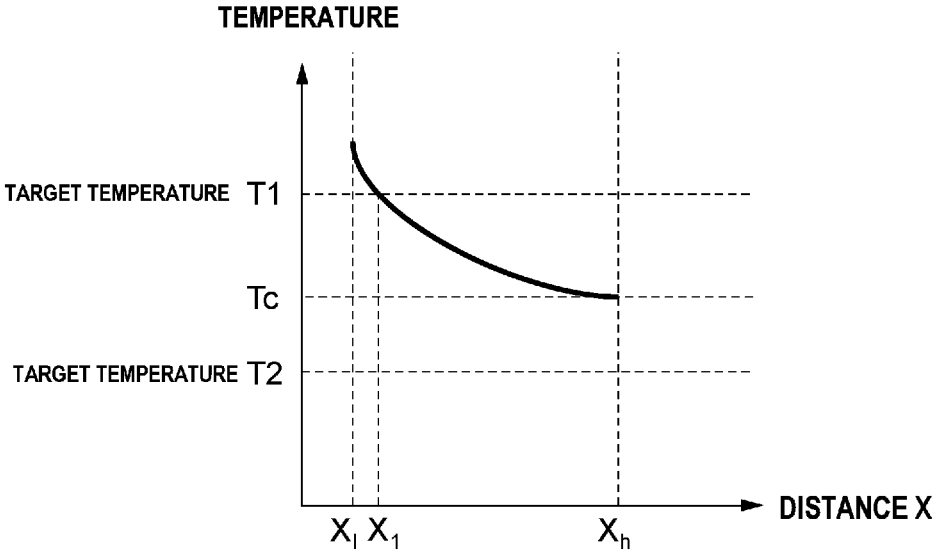
FIG. 4 is a graph showing an example of a relationship between a distance between the heat exchanger and the polishing pad, and the pad surface temperature.

FIG. 3 is a schematic view showing a manner in which the heat exchanger 11 regulates the pad surface temperature. FIG. 4 is a graph showing an example of a relationship between a distance between the heat exchanger 11 and the polishing pad 3, and the pad surface temperature. In the following description, the distance between the heat exchanger 11 and the polishing pad 3 may be referred to as the "separation distance". In FIG. 4, a vertical axis represents the temperature of the surface of the polishing pad 3 (i.e., the pad surface temperature), and the horizontal axis represents the separation distance. The graph shown in FIG. 4 illustrates an example of the pad surface temperature that changes as the heat exchanger 11 maintained at the predetermined temperature is moved with respect to the polishing pad 3.

The controller 40 stores in advance the relationship between the separation distance and the pad surface temperature. For example, the controller 40 stores in advance a graph as shown in FIG. 4, or a relational expression between the separation distance and the pad surface temperature obtained from that graph. In one embodiment, the controller 40 may store in advance a data table between the separation distance and the pad surface temperature obtained from the graph as shown in FIG. 4. The graph as shown in FIG. 4 may be obtained by experiments or by simulations.

The pad-temperature regulating apparatus 5 has at least one distance sensor 14 capable of measuring the distance between the heat exchanger 11 and the surface of the polishing pad 3. In the embodiment shown in FIGS. 1 and 3, the distance sensor 14 is mounted on an outer surface of the heat exchanger 11. The distance sensor 14 is also connected to the controller 40, and sends measured values thereof to the controller 40.

As described above, the controller 40 controls the position of the heat exchanger 11 with respect to the polishing pad 3 in the vertical direction using the elevating mechanism 71, such that the measured value of the pad-temperature measuring device 39 matches the predetermined target temperature. In the following, the method of regulating the pad surface temperature by use of the pad-temperature regulating apparatus 5 will be described in more detail.

First, the controller 40 moves the heat exchanger 11 until the distance between the heat exchanger 11 and the polishing pad 3 reaches a separation distance X1 (see FIG. 4) corresponding to the predetermined target temperature T1. More specifically, the controller 40 calculates the amount of movement of the heat exchanger until the distance between the heat exchanger 11 and the polishing pad 3 reaches the separation distance X1 based on the measured value of the distance sensor 14, and determines the amount of operation of the actuator 74 of the elevating mechanism 71 which corresponds to the obtained amount of movement. The controller 40 instructs the actuator 74 based on the amount of operation of the actuator 74 to move the heat exchanger 11.

Next, the controller 40 instructs the actuator 74 of the elevating mechanism 71 to increase (or decrease) the separation distance X if the measured value of the pad-temperature measuring device 39 is higher (or lower) than the predetermined target temperature T1. In this case, the amount of movement of the heat exchanger 11 is determined based on a difference between the target temperature T1 and the measured value of the pad-temperature measuring device 39. More specifically, the controller 40 calculates the difference between the target temperature T1 and the measured value of the pad-temperature measuring device 39, and determines the amount of movement of the heat exchanger 11 so as to set that difference to zero from the graph as shown in FIG. 4, or from the relational expression (or data table) between the separation distance and the pad surface temperature obtained from that graph. Each time the distance of the heat exchanger 11 with respect to the polishing pad 3 is changed, the controller 40 stores a combination of the separation distance X and the pad surface temperature (i.e., the measured value of the pad-temperature measuring device 39) corresponding to the separation distance X.

In this manner, the controller 40 changes the separation distance X of the heat exchanger 11, whose temperature is maintained at the predetermined temperature, with respect to the polishing pad 3 in order to regulate the pad surface temperature to the target temperature. The heat exchanger 11 is always located above the polishing pad 3, and the controller 40 does not allow the heat exchanger 11 to come into contact with the polishing pad 3. Therefore, dirt, such as abrasive grains contained in the polishing liquid, and abrasion powder of the polishing pad 3, does not adhere to the heat exchanger 11, so that defects, such as scratches, and contaminations on the wafer (substrate) W are prevented. Furthermore, in order to regulate the surface temperature of the polishing pad 3 to the target temperature, the controller 40 controls only the distance of the heat exchanger 11 with respect to the polishing pad 3. Therefore, simple control allows the responsiveness of the control of the surface temperature of the polishing pad 3 to be improved.

The elevating mechanism 71 inevitably has an upper limit and a lower limit of the amount of movement of the heat exchanger 11. The lower limit of the amount of movement of the heat exchanger 11 (see the separation distance X1 in FIG. 4) is the limit at which the heat exchanger 11 can be brought into close to the surface of the polishing pad 3, and is determined in advance. The controller 40 stores in advance an amount of operation of the actuator 74 corresponding to the lower limit of the amount of movement of the heat exchanger 11, and is configured not to send an instruction exceeding this amount of operation to the actuator 74.

The upper limit of the amount of movement of the heat exchanger 11 (see the separation distance Xh in FIG. 4) is, for example, a physical or mechanical operating limit of the elevating mechanism 71. If there exist other components of the polishing apparatus directly above the heat exchanger 11, the upper limit of the amount of movement of the heat exchanger 11 is determined in advance so that the heat exchanger 11 does not come into contact with the other components. In this manner, there is a limit to move the heat exchanger 11 away from the surface of the polishing pad 3. Accordingly, as shown in FIG. 4, if the predetermined target temperature is set to a target temperature T2 lower than the pad surface temperature Tc corresponding to the upper limit of movement of the elevating mechanism 71 (i.e., the separation distance Xh shown in FIG. 4), the heat exchanger 11 maintained at the predetermined temperature cannot decrease the temperature of the surface of the polishing pad 3 to the target temperature T2.

Figure 5:
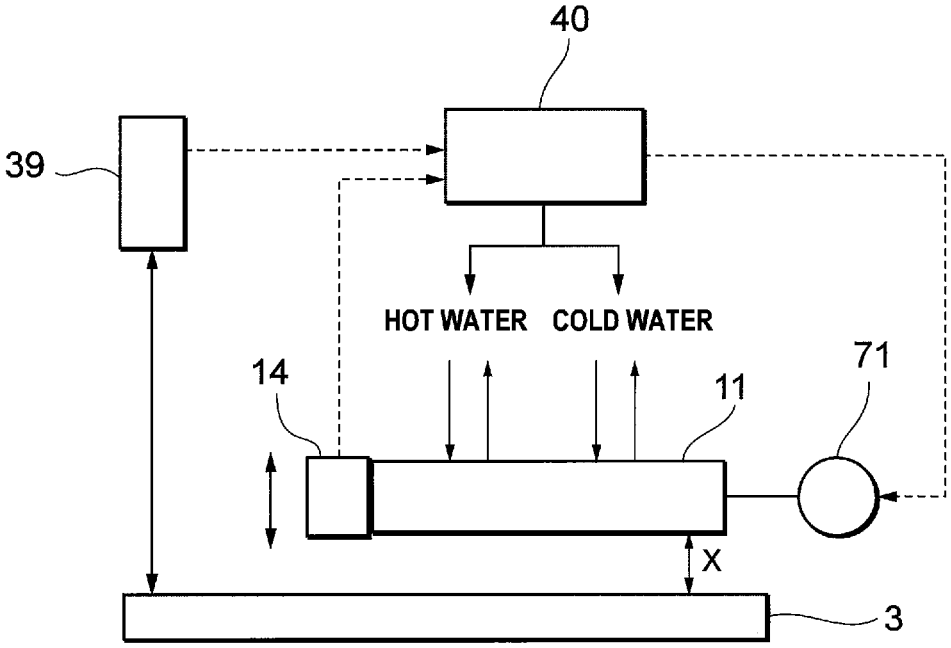
FIG. 5 is a schematic view showing a manner in which a cooling-liquid supply system is operated to regulate the pad surface temperature.

In this case, the controller 40 operates the cooling-liquid supply system (cooling mechanism) 50 described above. FIG. 5 is a schematic view showing a manner in which the cooling-liquid supply system 50 is operated to regulate the pad surface temperature. As shown in FIG. 5, the cooling liquid is supplied into the heat exchanger 11 by the cooling-liquid supply system 50 (see FIG. 1). Although, in this case also, the heating liquid regulated to the predetermined temperature continues to be supplied into the heat exchanger 11 at the predetermined flow rate, the temperature of the heat exchanger 11 is decreased by the cooling liquid supplied from the cooling-liquid supply system 50. As a result, the temperature of the surface of the polishing pad 3 can be decreased to the target temperature T2, which is lower than the pad surface temperature Tc.

The controller 40 adjusts the flow rate of the cooling liquid supplied into the heat exchanger 11 based on the measured value of the pad-temperature measuring device 39. More specifically, the controller 40 controls the opening degree of the second flow control valve 56 (see FIG. 1) to adjust the flow rate of the cooling liquid supplied to the heat exchanger 11, such that the measured value of the pad-temperature measuring device 39 matches the target temperature T2.

In the case where the predetermined target temperature is set to the target temperature T2 lower than the pad surface temperature Tc corresponding to the upper limit of movement of the elevating mechanism 71, the controller 40 controls the flow rate of the cooling liquid without controlling the amount of operation of the elevating mechanism 71 (i.e., the position of the heat exchanger 11 in the vertical direction). In this case also, the parameter to be controlled by the controller 40 in order to regulate the pad surface temperature to the predetermined target temperature is only the flow rate of the cooling liquid. Therefore, with simple control, the responsiveness of the control of the surface temperature of the polishing pad 3 can be improved.

Furthermore, the cooling liquid is used only when the predetermined target temperature is set to the temperature lower than the pad surface temperature Tc corresponding to the upper limit of movement of the elevating mechanism 71. Therefore, the pad temperature regulating apparatus 5 according to this embodiment can reduce an amount of cooling liquid used, compared to the conventional pad-temperature regulating apparatus which always supplies cooling liquid to the heat exchanger. As a result, cost of producing the cooling liquid is decreased, and thus running cost of the pad-temperature regulating apparatus 5 can be decreased.

Figure 6:
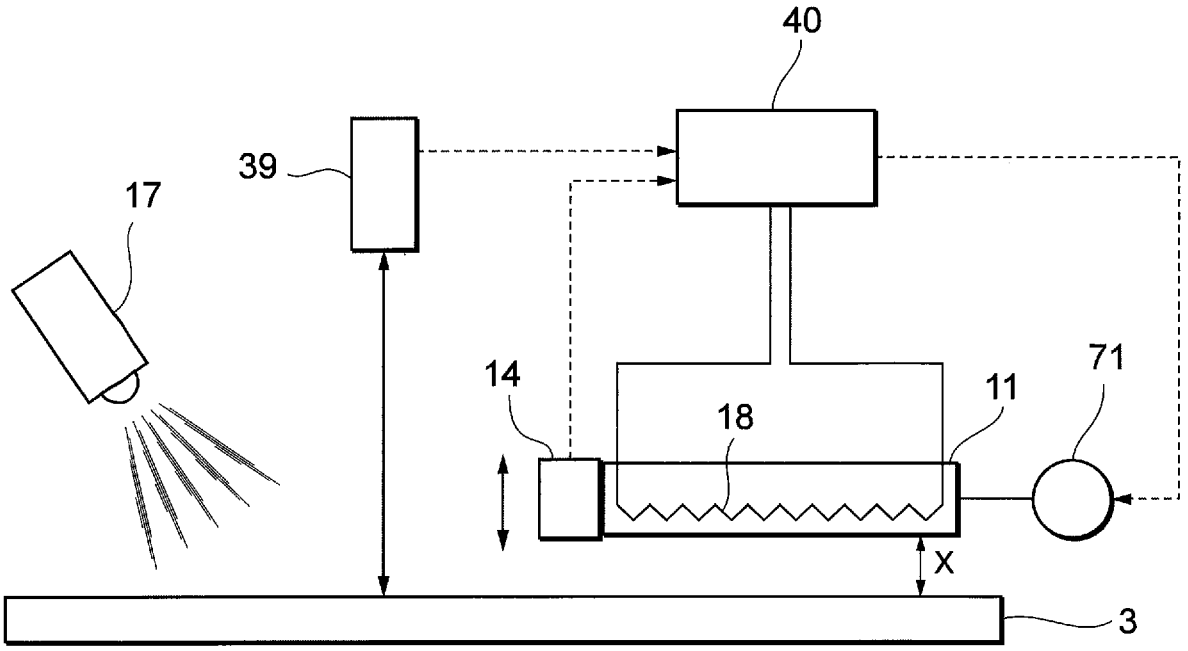
FIG. 6 is a schematic view showing a manner in which the heat exchanger according to another embodiment regulates the pad surface temperature.

FIG. 6 is a schematic view showing a manner in which the heat exchanger 11 according to another embodiment regulates the pad surface temperature. Configuration of this embodiment, which is not specifically described, is the same as the configuration of the above-described embodiments, and thus duplicate descriptions thereof are omitted.

The heat exchanger 11 shown in FIG. 6 has a heater 18 instead of the heating-liquid supply system 30. The heater 18 is connected to the controller 40. The controller 40 controls a current and a voltage supplied to the heater 18 to a constant level. As a result, the heat exchanger 11 is heated to the predetermined temperature, and maintained at that predetermined temperature.

In the embodiment shown in FIG. 6, a gas injection nozzle 17 for injecting gas onto the surface of the polishing pad 3 is provided instead of the cooling-liquid supply system 50. The gas injection nozzle 17 serves as the cooling mechanism for cooling the surface of the polishing pad 3.

In this embodiment also, the pad-temperature regulating apparatus 5 moves the heat exchanger 11, whose temperature is maintained at the predetermined temperature, vertically with respect to the polishing pad 3 based on the measured values of the pad-temperature measuring device 39 to thereby regulate the pad surface temperature to the target temperature. In the case where the predetermined target temperature is set to the target temperature T2 lower than the pad surface temperature Tc corresponding to the upper limit of movement of the elevating mechanism 71, the gas injection nozzle (cooling mechanism) 17 is set in motion. The controller 40 controls a flow rate of the gas injected from the gas injection nozzle 17 based on the measured values of the pad-temperature measuring device 39.

Figure 7:
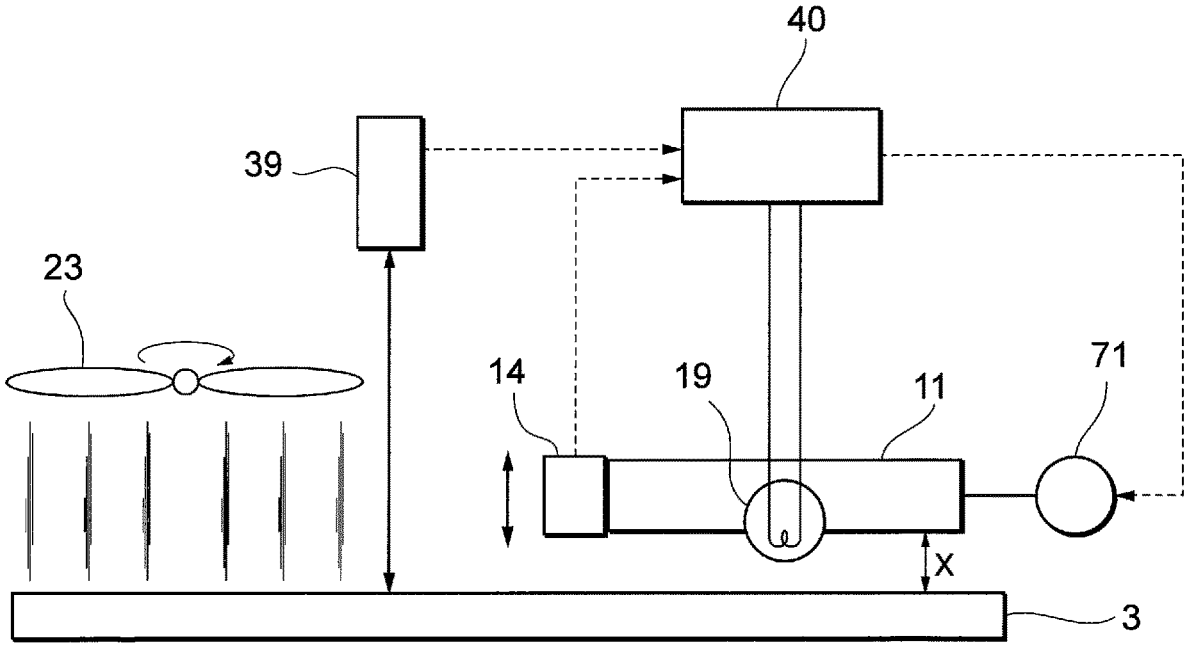
FIG. 7 is a schematic view showing a manner in which the heat exchanger according to still another embodiment regulates the pad surface temperature.

FIG. 7 is a schematic view showing a manner in which the heat exchanger 11 according to still another embodiment regulates the pad surface temperature. Configuration of this embodiment, which is not specifically described, is the same as the configuration of the above-described embodiments, and thus duplicate descriptions thereof are omitted.

The heat exchanger 11 shown in FIG. 7 has a heater lamp 19 instead of a heating-liquid supply system 30. The heater lamp 19 is connected to the controller 40, which controls a current and a voltage supplied to the heater lamp 19 to a constant level. As a result, the heat exchanger 11 is heated to the predetermined temperature, and maintained at that predetermined temperature.

In the embodiment shown in FIG. 7, a cooling fan 23 that generates airflow directed to the surface of the polishing pad 3 instead of the cooling-liquid supply system 50. The cooling fan 23 serves as the cooling mechanism for cooling the surface of the polishing pad 3.

In this embodiment also, the pad-temperature regulating apparatus 5 moves the heat exchanger 11, whose temperature is maintained at the predetermined temperature, vertically with respect to the polishing pad 3 based on the measured values of the pad-temperature measuring device 39 to thereby regulate the pad surface temperature to the target temperature. In the case where the predetermined target temperature is set to the target temperature T2 lower than the pad surface temperature Tc corresponding to the upper limit of movement of the elevating mechanism 71, the cooling fan (cooling mechanism) 23 is set in motion. The controller 40 controls a rotation speed of the cooling fan 23 based on the measured values of the pad-temperature measuring device 39.

In one embodiment, the pad-temperature regulating apparatus 5 shown in FIG. 6 may have the cooling fan 23 instead of the gas injection nozzle 17. The pad-temperature regulating apparatus 5 shown in FIG. 7 may have the gas injection nozzle 17 instead of the cooling fans 23.

The distance sensor 14 can be any sensor as long as the distance between the heat exchanger 11 and the surface of the polishing pad 3 can be measured in a non-contact manner. Examples of the distance sensor 14 include a laser type sensor, an ultrasonic sensor, an eddy current type sensor, or a capacitance sensor. In the embodiment shown in FIGS. 1 and 3, only one distance sensor 14 is attached to the heat exchanger 11. However, the pad-temperature regulating apparatus 5 may have a plurality (e.g., four) of distance sensors 14 that are arranged at equal intervals along a periphery of the heat exchanger 11. When the pad-temperature regulating apparatus 5 has the plurality of distance sensors 14, the controller 40 may use an average of the measured values of the plurality of distance sensors 14 as the separation distance, or use the maximum (or minimum) value of the measured values of the plurality of distance sensors 14 as the separation distance.

The controller 40 of the pad-temperature regulating apparatus 5 may predict or determine an appropriate amount of operation of the elevating mechanism 71 (or an appropriate separation distance between the heat exchanger 11 and the polishing pad 3) for quickly converging the pad surface temperature to and maintaining it at the predetermined target temperature, using a learned model constructed by performing machine learning.

The machine learning is performed by a learning algorithm, which is an artificial intelligence (AI) algorithm, and the machine learning constructs a learned model that predicts the appropriate amount of operation of the elevating mechanism 71. The learning algorithm for constructing the learned model is not particularly limited. For example, a known learning algorithm, such as "supervised learning", "unsupervised learning", "reinforcement learning", "neural network," and the like can be used as the learning algorithm for learning the appropriate amount of operation of the elevating mechanism 71.

Figure 8:
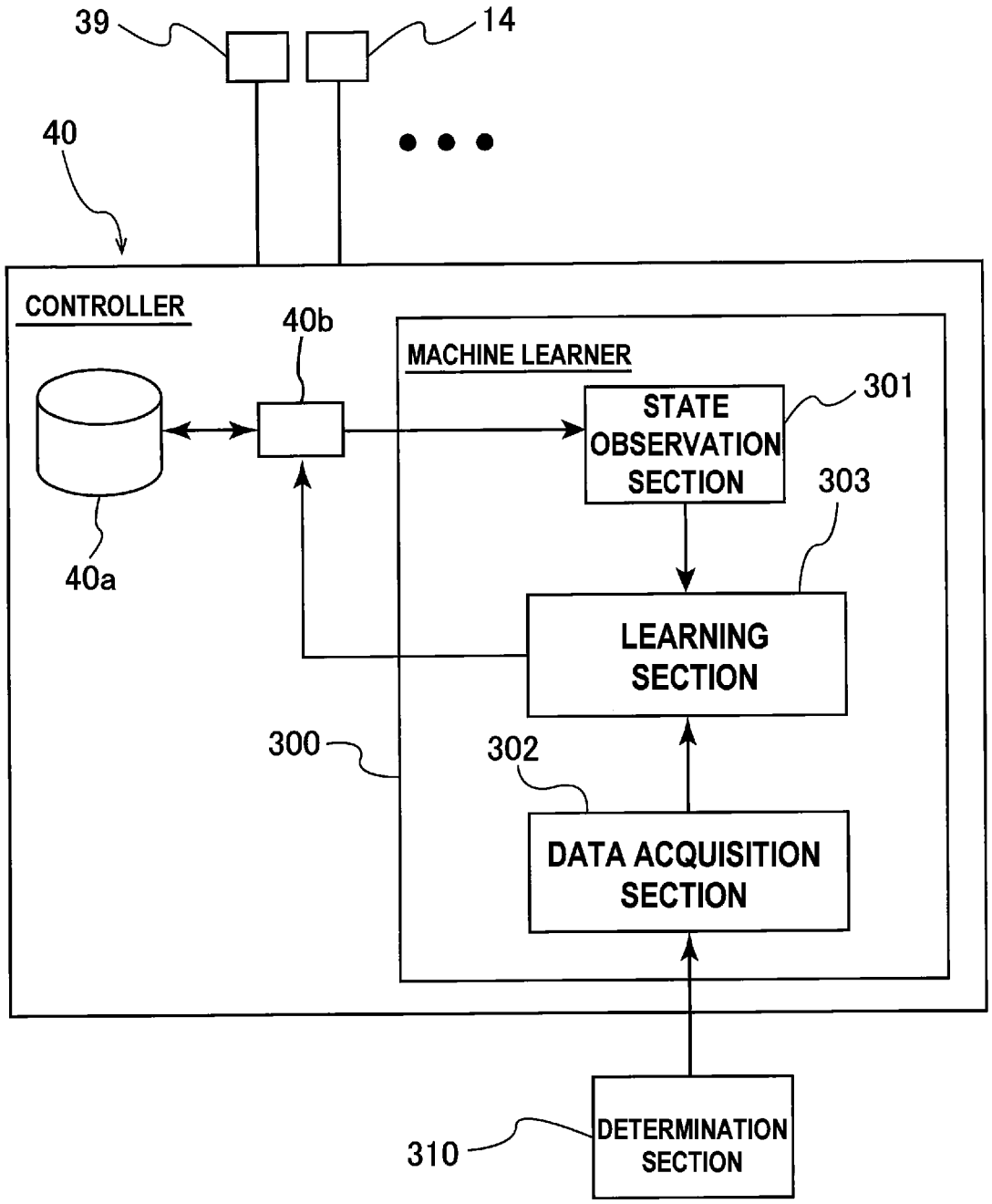
FIG. 8 is a schematic view showing an example of a controller capable of performing a machine learning to construct a learned model for an appropriate amount of operation of an elevating mechanism.

FIG. 8 is a schematic view showing an example of a controller 40 capable of performing a machine learning to construct a learned model. This controller 40 includes a memory 40*a* in which programs, data, and the learned model are stored, a processing device 40*b*, such as CPU (central processing unit) or GPU (graphics processing unit), for performing arithmetic operation according to the programs stored in the memory 40*a*, and a machine learner 300 for constructing the learned model to predict the appropriate amount of operation of the elevating mechanism 71. In one embodiment, the machine learner 300 for constructing the learned model to predict the appropriate amount of operation of the elevating mechanism 71 may be provided separately from the controller 40.

The machine learner 300 shown in FIG. 8 is an example of a machine learner capable of learning the appropriate amount of operation of the elevating mechanism 71. This machine learner 300 includes a state observation section 301, a data acquisition section 302, and a learning section 303.

The state observation section 301 observes state variables as input values for machine learning. The state variable is a generic term for temperature control parameters related to the control of the pad surface temperature. In this embodiment, the state variables include at least the measured value of the pad surface temperature acquired by the pad-temperature measuring device 39, and the measured value of the distance sensor 14 (i.e., the separation distance) when the pad-temperature measuring device 39 acquires the pad surface temperature.

The data acquisition section 302 acquires movement amount data from a determination section 310. The movement amount data is data used in constructing the learned model for predicting the appropriate amount of operation of the elevating mechanism 71, and corresponds to data obtained, according to a known measurement method, by measuring a relationship between an amount of change in movement when the separation distance between the heat exchanger 11, which is maintained at a certain temperature, and the polishing pad 3 is changed, and an amount of change in the temperature of the surface of the polishing pad 3 corresponding to said amount of change in movement. The movement amount data is associated (linked) with the state variable that is input to the state observation section 301.

An example of the machine learning performed by the machine learner 300 is as follows. First, a state observation section 301 acquires the state variables including at least the separation distance and the temperature of the surface of the polishing pad 3 corresponding to that separation distance, and the data acquisition section 302 acquires the movement amount data associated with those state variables acquired by the state observation section 301. The learning section 303 learns the appropriate amount of operation of the elevating mechanism 71 based on the training data set, which comprises combinations of the state variables acquired from the state observation section 301 and the movement amount data acquired from the data acquisition section 302. The machine learning performed by the machine learner 300 is repeatedly performed until the machine learner 300 can become to output the appropriate amount of operation of the elevating mechanism 71.

In one embodiment, the machine learning performed by the learning section 303 of the machine learner 300 may be a machine learning using neural network, in particular, deep learning. The deep learning is a neural-network-based learning method, and in that neural network, hidden layers (also referred to middle layers) are multilayered. In the present specification, a machine learning using a neural network constructed of an input layer, two or more hidden layers, and an output layer is referred to as deep learning.

Figure 9:
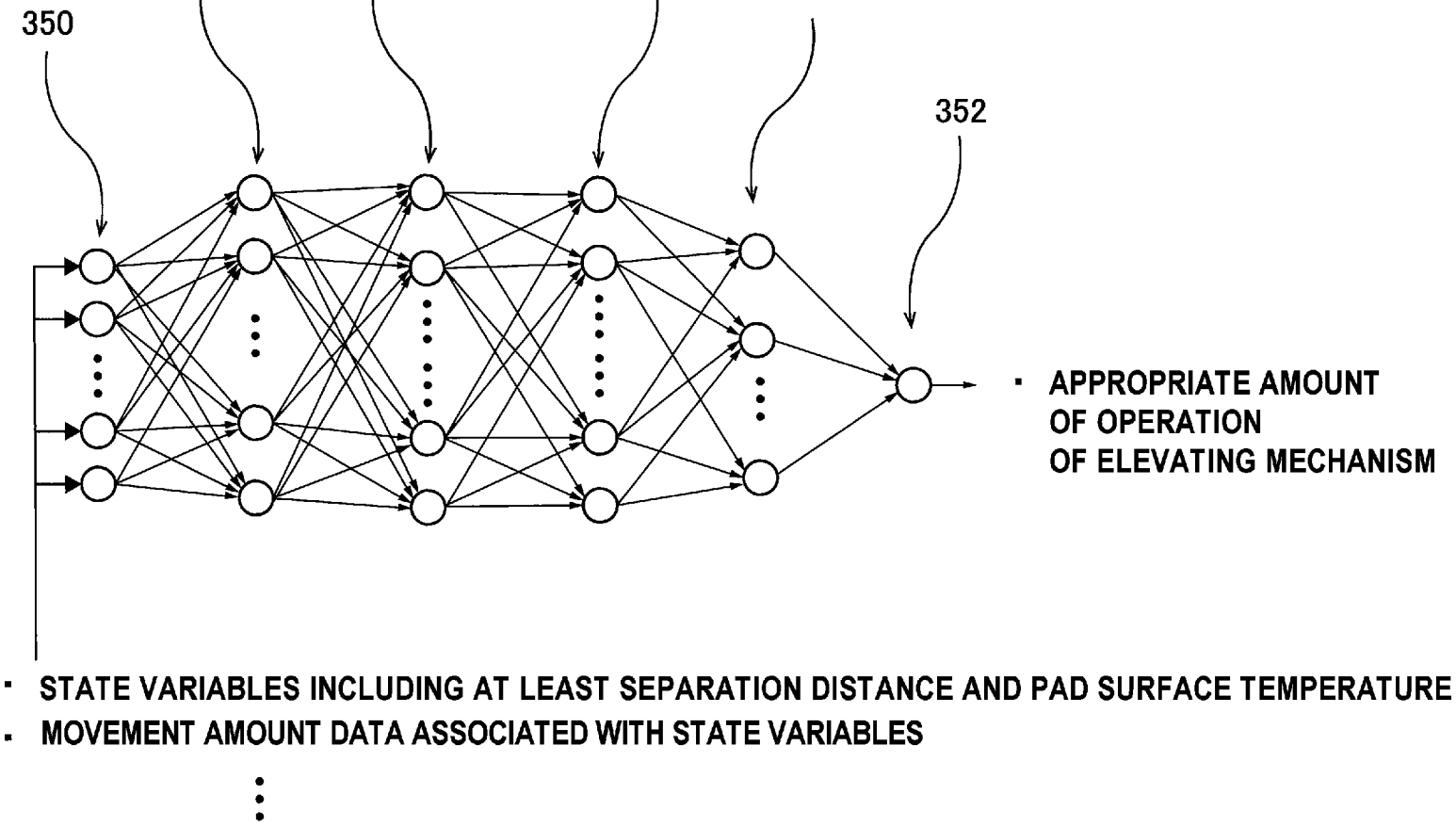
FIG. 9 is a schematic view showing an example of structure of neural network.

FIG. 9 is a schematic view showing an example of structure of neural network. The neural network shown in FIG. 9 includes an input layer 350, a plurality of hidden layers 351, and an output layer 352. The neural network learns the appropriate amount of operation of the elevating mechanism 71 based on the training data set, which comprises a number of combinations of the state variables acquired by the state observation section 301 and the movement amount data associated with those state variables and acquired by the data acquisition section 302. In other words, the neural network learns a relationship between the state variables and the amount of operation of the elevating mechanism 71. This type of machine learning is so-called "supervised learning". The supervised learning inputs a large number of combinations of the state variables and the movement amount data (labels) associated with those state variables to the neural network to learn a relationship between them inductively.

In one embodiment, the neural network may learn the appropriate amount of operation of the elevating mechanism 71 by so-called "unsupervised learning". For example, the unsupervised learning inputs only a large number of state variables into the neural network to learn how the state variables are distributed. Then, the unsupervised learning performs, even without inputting the teacher output data (movement amount data) corresponding to the state variables into the neural network, compression, classification, shaping, or the like with respect to the input state variables to thereby construct the learned model for outputting the appropriate amount of operation of the elevating mechanism 71. Specifically, in unsupervised learning, the neural network classes a large number of input state variables into a plurality of groups with some similar features. The neural network then establishes criterion defined for outputting the appropriate amount of operation of the elevating mechanism 71 for the plurality of groups that have been classified, and constructs the learned model so that a relationship between them is optimized, thereby outputting the appropriate amount of operation of the elevating mechanism 71.

Further, in one embodiment, the machine learning performed in the learning section 303 may use a so-called "recurrent neural network (RNN)" in order to reflect temporal changes in the state variables into the learned model. The recurrent neural network utilizes not only the state variables at the current time, but also the state variables that have been input to the input layer 350 in past. The recurrent neural network, assuming the changes in the state variables expanded along time axis, can construct the learned model for predicting the appropriate amount of operation of the elevating mechanism 71 in light of transitions of the state variables that have been input in past.

Figure 10A:
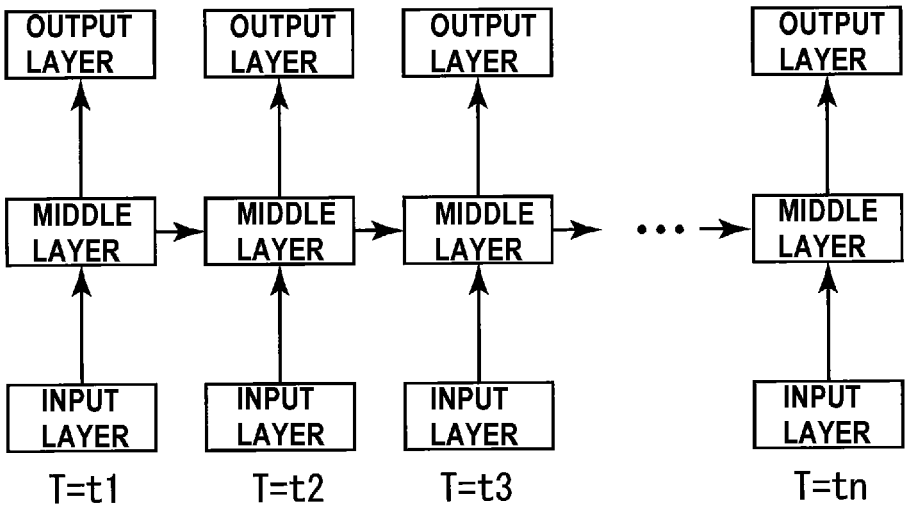
FIGS. 10A and 10B are development views each of which illustrates a simple recurrent network (Elman network), which is an example of the recurrent neural network.
Figure 10B:
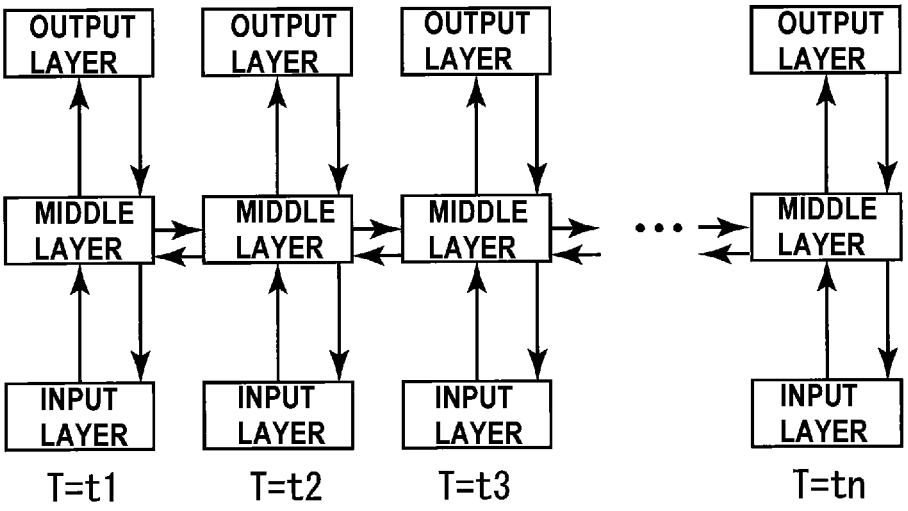

FIGS. 10A and 10B are development views each of which illustrates a simple recurrent network (Elman network), which is an example of the recurrent neural network. More specifically, FIG. 10A is a schematic view showing a time expansion of Elman network, and FIG. 10B is a schematic view showing Back Propagation Through Time in an error backpropagation method (which is also referred to as "back-propagation").

In Elman network as shown in FIGS. 10A and 10B, unlike ordinary neural networks, errors propagate backward in time (see FIG. 10B). Such a recurrent neural network structure is applied to the neural network of machine learning performed by the learning section 303, enabling the learned model that outputs the appropriate amount of operation of the elevating mechanism 71 in light of the transitions of the state variables inputted in past.

The learned model constructed in this manner is stored in the memory 40*a* (see FIG. 8) of the controller 40. The controller 40 operates according to a program electrically stored in the memory 40*a*. More specifically, the processing device 40*b* of the controller 40 performs operations: to input the state variables, including at least the separation distance and the pad surface temperature corresponding to that separation distance each of which are sent to the controller 40 from the pad-temperature measuring device 39 and the distance sensor 14, into the input layer 350 of the learned model; and to predict the amount of operation of the elevating mechanism 71 to reach the pad surface temperature to the predetermined target temperature from the input state variables (and the temporal change amount in the state variables) to output the predicted amount of operation from the output layer 352. The controller 40 moves the heat exchanger 11 in the vertical direction based on the amount of operation of the elevating mechanism 71 that is output from the output layer 352. Such control allows the pad surface temperature to be adjusted to the target temperature more quickly and accurately.

When the amount of operation of the elevating mechanism 71 output from the output layer 352 is determined to be equivalent to the normal data, the controller 40 may store this amount of operation of the elevating mechanism 71 in the determination section 310 as additional teacher data. In this case, the machine learner 300 performs the machine learning based on the teacher data and the additional teacher data to update the learned model. As a result, accuracy in the amount of operation of the elevating mechanism 71 outputted from the learned model can be improved.

In one embodiment, some of the state variables shown below may be selected as state variables to be further input to the state observation section 301. Alternatively, all of the state variables shown below may be input to the state observation section 301.

(1) type of the polishing pad 3

(2) thickness of the polishing pad 3

(3) amount of wear of the polishing pad 3

(4) rotation speed of the polishing head 1

(5) pressing load of the polishing head 1 (i.e., the wafer W) with respect to the polishing pad 3

(6) rotation speed of the polishing table 2

(7) type of abrasive grains contained in the polishing liquid (slurry)

(8) flow rate of the polishing liquid (9) temperature of the polishing liquid

(10) set temperature of the heat exchanger 11

(11) temperature of atmosphere in the polishing apparatus

These state variables (1) to (10) are related to the change in the pad surface temperature. Specifically, if any one of the state variables (1) to (10) changes, an amount of frictional heat generated between the wafer W and the polishing pad 3 is changed. Therefore, under conditions where any one of the state variables (1) to (10) is different, the pad surface temperature reached is different even if the heat exchanger 11 heats the surface of the polishing pad 3 at the same separation distance. The same phenomenon occurs under conditions where the temperatures of ambient in the polishing apparatus are different from each other.

Accordingly, at least one of these state variables (1) to (11) is further input into the state observation section 301, and is utilized in the machine learning for constructing the learned model, enabling the learned model to output a more accurate amount of operation of the elevating mechanism 71.

Figure 11:
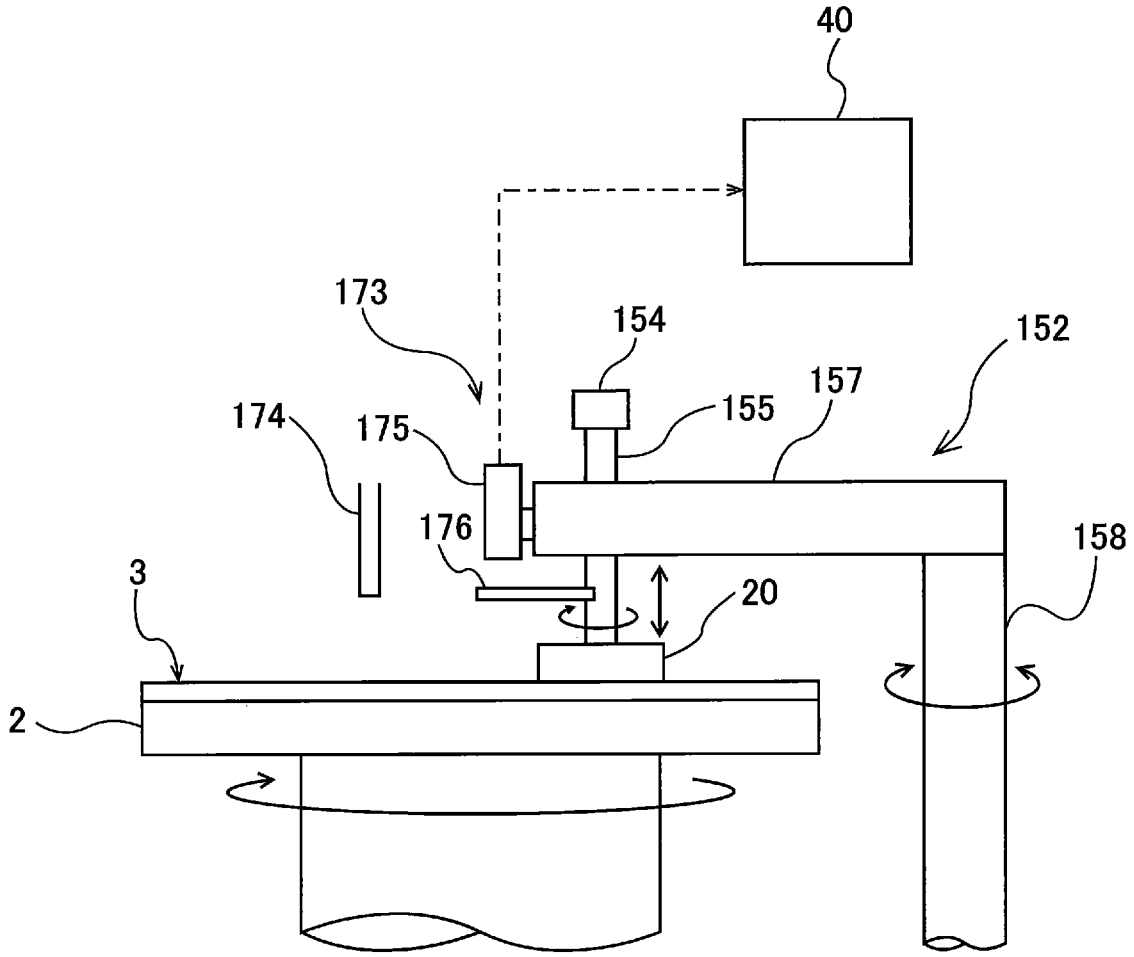
FIG. 11 is a schematic view showing an example of a polishing apparatus having a pad-height measuring device for obtaining a profile of the polishing pad.

Next, a method for measuring the amount of wear of the polishing pad 3 will be described with reference to FIG. 11. FIG. 11 is a schematic view showing an example of a polishing apparatus having a pad-height measuring device for obtaining a profile of the polishing pad 3.

The polishing apparatus shown in FIG. 11 further include a dressing apparatus 152 provided to restore the surface of the polishing pad 3, which deteriorates as polishing of the wafer W is repeatedly performed, and a pad-height measuring device 173 attached to the dressing apparatus 152. As will be described below, the pad-height measuring device 173 measures a height of the surface of the polishing pad 3, and the controller 40 calculates the amount of wear of the polishing pad 3 based on the acquired height of the surface of the polishing pad 3.

The dressing apparatus 152 includes the above-mentioned dresser 20 (see FIG. 1) for dressing the surface of the polishing pad 3, a dresser shaft 155 to which the dresser 20 is coupled, a pneumatic cylinder 154 mounted to an upper end of the dresser shaft 155, and a dresser arm 157 for rotatably supporting the dresser shaft 155. A lower surface of the dresser 20 serves as a dressing surface, and this dressing surface is formed by abrasive grains (e.g., diamond particles). The pneumatic cylinder 24 is fixed to the dresser arm 157 through a support mechanism (not shown).

The dresser arm 157 is actuated by a motor (not shown) to pivot on a dresser pivot shaft 158. The dresser 20 is rotated together with the dresser shaft 155 by a rotation mechanism (not shown) installed in the dresser arm 157. The pneumatic cylinder 154 serves as an actuator for pressing the dresser 20 against the surface of the polishing pad 3 through the dresser shaft 155 at a predetermined pressing load (pressing force). When the dresser arm 157 pivots around the dresser pivot axis 158, the dresser 20 oscillates on the surface of the polishing pad 3 in the approximate radial direction of the polishing table 2.

During dressing of the polishing pad 3, the dresser 20 is rotated about the dresser shaft 155, and a dressing liquid is supplied from the liquid supply nozzle 174 onto the polishing pad 3. In this state, the dresser 20 is pressed against the polishing pad 3 to place the dressing surface (i.e., the lower surface of the dresser 20) in sliding contact with the surface of the polishing pad 3. Further, the dresser arm 157 pivots around the dresser pivot shaft 158 to cause the dresser 7 to oscillate in the radial direction of the polishing pad 3. In this manner, the dresser 20 scrapes the polishing pad 3 to thereby dress (or restore) the surface of the polishing pad 3.

The pad-height measuring device 173 shown in FIG. 11 includes a pad-height sensor 175 for measuring a height of the surface of the polishing pad 3, and a sensor target 176 disposed opposite the pad-height sensor 175. The pad-height sensor 175 is connected to the controller 40.

The pad-height sensor 175 is secured to the dresser arm 157, and the sensor target 176 is secured to the dresser shaft 155. The sensor target 176 vertically moves together with the dresser shaft 155 and the dresser 20. In contrast, a vertical position of the pad-height sensor 175 is fixed. The pad-height sensor 175 is a displacement sensor, which is configured to measure a displacement of the sensor target 176 to thereby indirectly measure the height of the surface of the polishing pad 3 (or a thickness of the polishing pad 3). Since the sensor target 176 is vertically moved together with the dresser 20, the pad-height sensor 175 can measure the height of the surface of the polishing pad 3 during dressing of the polishing pad 3. The pad-height sensor 101 may comprise any type of sensors, such as a linear scale sensor, a laser sensor, an ultrasonic sensor, an eddy current sensor, and a capacitance sensor.

The pad-height sensor 175 is connected to the controller 40, and an output signal of the pad-height sensor 175 (i.e., a measured value of the height of the surface of the polishing pad 3) is sent to the controller 40. The controller 40 can obtain a profile of the polishing pad 3 (i.e., a cross-sectional shape of the surface of the polishing pad 3) from measured values of the height of the surface of the polishing pad 3.

After the unused polishing pad 3 is attached to the polishing table 2, the controller 40 acquires an initial height of the polishing pad 3 by use of the pad-height measuring device 173, and stores the initial height in the memory **40*a* (see FIG. 8). Each time a predetermined number of wafers W are polished, or each time the polishing pad 3 is dressed, the controller 40 measures the height (i.e., wear height) of the polishing pad 3 by use of the pad-height measuring device 173. The controller 40 subtracts the wear height from the initial height, enabling the amount of wear of the polishing pad 3 to be calculated. In this manner, the controller 40 can obtain the amount of wear of the polishing pad 3 as a state variable that is input to the state observation section 301**.

When the polishing apparatus has a pad-height measuring device 173, the controller 40 may calculate the separation distance between the polishing pad 3 and the heat exchanger 11 by use of the pad height sensor 175 instead of the distance sensor 14 described above, to control the operation of the elevating mechanism 71. In this case, the controller 40 stores in advance the initial position of the heat exchanger 11 relative to a predetermined reference surface.

The predetermined reference surface is, for example, the dressing surface of the dresser 20 retreated above the polishing pad 3 after dressing has been performed. The initial position is, for example, a standby position of the heat exchanger 11 when polishing of the wafer W is not performed. The controller 40 moves the heat exchanger 11 to the initial position using the elevating mechanism 71 each time the polishing of the wafer W is completed.

As described above, the controller 40 stores the initial height of the polishing pad 3. Therefore, the controller 40 can calculate a distance between the heat exchanger 11 lying in the initial position and the unused polishing pad 3. Furthermore, the controller 40 can obtain the current height of the polishing pad 3 by placing the dresser 20 into contact with the surface of the polishing pad 3 each time the wafer W is polished. Accordingly, the controller 40 can calculate a distance between the heat exchanger 11 lying in the initial position and the current surface of the polishing pad 3.

Therefore, the controller 40 can calculate the amount of operation of the actuator 74 by subtracting the separation distance from the distance between the heat exchanger 11 lying in the initial position and the current surface of the polishing pad 3. According to this embodiment, the pad height sensor 175 is used as a sensor to make the heat exchanger 11 reach the separation distance. In other words, the pad height sensor 175 is used in place of the distance sensor 14 described above, which measures the separation distance between the polishing pad 3 and the heat exchanger 11. Therefore, when the polishing apparatus has a pad-height measuring device 173, manufacturing cost of the pad-temperature regulating apparatus 5 can be reduced because the distance sensor 14 is no longer needed.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A pad-temperature regulating apparatus for regulating a surface temperature of a polishing pad to a predetermined target temperature, comprising:

a heat exchanger disposed above the polishing pad, whose temperature is maintained at a predetermined temperature;

a pad-temperature measuring device configured to measure the surface temperature of the polishing pad;

a distance sensor configured to measure a separation distance between the polishing pad and the heat exchanger, and mounted on an outer surface of the heat exchanger;

an elevating mechanism for moving the heat exchanger vertically with respect to the polishing pad; and a controller configured to control operation of the elevating mechanism based on measured values of the pad-temperature measuring device, and measured values of the distance sensor.

2. The pad-temperature regulating apparatus according to claim 1, wherein the heat exchanger includes a heating flow passage formed therein, and the heating flow passage is supplied with a heating liquid, whose temperature is maintained at a predetermined temperature, at a predetermined flow rate.

3. The pad-temperature regulating apparatus according to claim 1, further comprising a cooling mechanism for cooling the surface of the polishing pad, wherein the controller operates the cooling mechanism when the target temperature is lower than the measured value of the pad-temperature measuring device after the elevating mechanism reaches an upper limit of movement of the heat exchanger.

4. The pad-temperature regulating apparatus according to claim 3, wherein the cooling mechanism includes a cooling flow passage formed in the heat exchanger, into which a cooling liquid is supplied, and the controller controls a flow rate of the cooling liquid based on the measured values of the pad-temperature measuring device.

5. The pad-temperature regulating apparatus according to claim 1, wherein the controller includes:

a memory which stores a learned model constructed by machine learning using training data including at least a combination of the distance between the heat exchanger and the polishing pad, and the temperature of the surface of the polishing pad corresponding to the distance; and a processing device for operating to input temperature control parameters which include at least the target temperature and the measured value of the pad-temperature measuring device into the learned model, and to output an amount of operation of the elevating mechanism.

6. A polishing apparatus, comprising:

a polishing table supporting a polishing pad;

a polishing head for pressing a substrate against the polishing pad; and a pad-temperature regulating apparatus according to claim 1.

7. The pad-temperature regulating apparatus according to claim 1, wherein the controller calculates an amount of movement of the heat exchanger until a distance between the heat exchanger and the polishing pad reaches the separation distance based on the measured value of the distance sensor;

determines an amount of operation of an actuator of the elevating mechanism which corresponds to the calculated amount of movement;

instructs the actuator based on the determined amount of operation of the actuator to move the heat exchanger, and instructs the actuator of the elevating mechanism to increase the separation distance if the measured value of the pad-temperature measuring device is higher than the predetermined target temperature, or to decrease the separation distance if the measured value of the pad-temperature measuring device is lower than the predetermined target temperature.

8. The pad-temperature regulating apparatus according to claim 7, wherein, when increasing or decreasing the separation distance, the controller calculates a difference between the target temperature and the measured value of the pad-temperature measuring device, and determines an amount of movement of the heat exchanger so as to set the difference to zero from a graph representing a relationship between a distance between the heat exchanger and the polishing pad, and the surface temperature of the polishing pad, or from a relational expression or data table between the separation distance and the surface temperature of the polishing pad obtained from the graph.

9. The pad-temperature regulating apparatus according to claim 1, further comprising a cooling fan for generating an airflow directed to the polishing pad to cool the polishing pad, wherein the cooling fan is disposed above the polishing pad and at a position separated from the heat exchanger.

10. The pad-temperature regulating apparatus according to claim 9, wherein the cooling fan is set in motion when the predetermined target temperature is set to a target temperature lower than a surface temperature of the polishing pad corresponding to an upper limit of movement of the elevating mechanism, and the controller controls a rotation speed of the cooling fan based on the measured values of the pad-temperature measuring device.

11. A pad-temperature regulating method for regulating a surface temperature of a polishing pad to a predetermined target temperature, comprising:

measuring the surface temperature of the polishing pad by use of a pad-temperature measuring device;

measuring a separation distance between the polishing pad and a heat exchanger, which is disposed above the polishing pad, and whose temperature is maintained at a predetermined temperature, by use of a distance sensor mounted on an outer surface of the heat exchanger; and moving the heat exchanger vertically with respect to the polishing pad based on measured values of the pad-temperature measuring device, and measured values of the distance sensor to thereby regulating the surface temperature of the polishing pad to the target temperature.

12. The pad-temperature regulating method according to claim 11, wherein, in order to maintain the heat exchanger at the predetermined temperature, a heating liquid, whose temperature is maintained at a predetermined temperature, is supplied at a predetermined flow rate to a heating flow passage formed in the heat exchanger.

13. The pad-temperature regulating method according to claim 11, wherein a cooling mechanism is used to cool the surface of the polishing pad when, after the heat exchanger reaches an upper limit of movement, the target temperature is lower than the measured value of the pad-temperature measuring device.

14. The pad-temperature regulating method according to claim 13, wherein cooling of the surface of the polishing pad is controlling of a flow rate of cooling liquid flowing through a cooling flow passage formed in the heat exchanger based on measured values of the pad-temperature measuring device.

15. The pad-temperature regulating method according to claim 11, wherein a learned model is constructed by machine learning using training data including at least a combination of a distance between the heat exchanger and the polishing pad, and a temperature of the surface of the polishing pad corresponding to the distance, and temperature control parameters, which include at least the target temperature and the measured value of the pad-temperature measuring device, are input to the learned model to output an amount of operation of the elevating mechanism.

* * * * *